US007852308B2

(12) United States Patent
Kim

(10) Patent No.: US 7,852,308 B2
(45) Date of Patent: Dec. 14, 2010

(54) SOURCE DRIVER AND DRIVING METHOD THEREOF

(75) Inventor: Hyung-Tae Kim, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 824 days.

(21) Appl. No.: 11/483,829

(22) Filed: Jul. 10, 2006

(65) Prior Publication Data

US 2007/0013641 A1 Jan. 18, 2007

(30) Foreign Application Priority Data

Jul. 14, 2005 (KR) ..... 10-2005-63865

(51) Int. Cl.
*G09G 3/36* (2006.01)

(52) U.S. Cl. ..... 345/100; 345/98; 345/211

(58) Field of Classification Search ..... 345/100, 345/98, 211
See application file for complete search history.

(56) References Cited

U.S. PATENT DOCUMENTS 5,311,145 A 5/1994 Huijsing et al.
6,331,846 B1 * 12/2001 Nakao ..... 345/96
6,480,178 B1 * 11/2002 Itakura et al. ..... 345/89

FOREIGN PATENT DOCUMENTS

| | | |
|---|---|---|
| JP | 05-206756 | 8/1993 |
| JP | 2000-151305 | 5/2000 |
| KR | 100292405 | 3/2001 |
| KR | 1020010090703 | 10/2001 |
| KR | 1020020013713 | 2/2002 |
| KR | 1020020059336 | 7/2002 |
| KR | 1020040018838 A | 3/2004 |
| KR | 1020060028120 | 3/2006 |

* cited by examiner

*Primary Examiner*—Alexander Eisen
*Assistant Examiner*—Stuart McCommas
(74) *Attorney, Agent, or Firm*—F. Chau & Associates, LLC

(57) ABSTRACT

A source driver for an LCD device. The source driver comprises a controller generating a pair of signals complimentary to each other, each of the signals toggling at a predetermined frame period, and an output buffer generating a data-line drive signal that is offset by positive and negative offset values in response to the pair of signals.

20 Claims, 5 Drawing Sheets

SOURCE DRIVER AND DRIVING METHOD THEREOF

CROSS-REFERENCE TO RELATED PATENT APPLICATIONS

This application claims priority to Korean Patent Application 2005-63865, filed on Jul. 14, 2005, in the Korean Intellectual Property Office, the disclosure of which is incorporated by reference herein.

BACKGROUND OF THE INVENTION

1. Technical Field

The present disclosure relates to display devices and specifically, to source drivers employed in liquid crystal display devices.

2. Discussion of the Related Art

Liquid crystal display (LCD) devices are widely used in portable computers and televisions because they can be miniaturized and require less power than conventional cathode ray tubes. An example of such an LCD device is an active matrix type which employs thin film transistors (TFTs) as switching devices for displaying motion pictures.

A conventional LCD device is composed of an LCD panel, a source driver block generating drive voltages to operate a plurality of data lines, and a gate driver block for operating a plurality of gate lines.

With the enlargement of LCD devices, LCD panels have become larger in size. As the size of an LCD panel increases, so does the number of data lines that need to be driven, which increases the number of output buffers arranged in the source driver block. The additional output buffers are required to eliminate offset components from output voltages in order to display an image on the LCD panel without distortion.

The offset components arising from the output buffers are generally classified into systematic offsets due to inherent circuit characteristics, and random offsets due to variation of temperature or processing conditions. While systematic offsets are relatively small and controllable by circuital modulation, random offsets are inestimable and can only be controlled in limited ways using circuital means. Therefore a need exists for a source driver capable of visually eliminating random offset components from output buffers in an LCD device.

SUMMARY OF THE INVENTION

An exemplary embodiment of the invention provides a source driver comprising a controller, and an output buffer. The controller generates a pair of signals complimentary to each other. Each the signals toggle at a predetermined frame period. The output buffer generates a data-line drive signal that is offset by positive and negative offset values in response to the pair of signals.

In an exemplary embodiment of the invention, the output buffer includes a differential input circuit generating differential currents from differential input voltages, current mirrors generating addition currents from the differential currents, a floating current source supplying constant bias currents to the current mirrors, a class-AB amplifier configured to amplify a voltage corresponding to the addition currents, and an output circuit configured to generate an output signal along the amplified voltage.

The differential input voltages may be toggled with an input signal and the output signal of the output buffer in response to the pair of signals.

Each of the current mirrors may include transistors which are alternately conductive in response to the pair signals.

The output buffer may maintain a current path through the current mirror regardless of the state of the differential input voltages.

The output buffer may further comprise a capacitive circuit for stabilizing frequency characteristics of the amplified voltage.

The capacitive circuit may be connected to the class-AB amplifier regardless of the state of the pair of signals.

In an exemplary embodiment of the invention, a method of driving a source driver having an output buffer is comprised of: generating a pair of signals which are each complimentary to one another and toggle at a predetermined frame period; generating a data-line drive signal that is offset by a positive offset value from the output buffer in response to the pair of signals; and generating a data-line drive signal that is offset by a negative offset value, subsequent to the data-line drive signal having the positive offset value, from the output buffer in response to the pair of signals.

The output buffer may respond to differential input voltages toggling with the pair of signals.

The positive and negative offset values may be generated from mismatching and processing conditions of transistors of the output buffer.

BRIEF DESCRIPTION OF THE DRAWINGS

The above and other features of the present invention will become readily apparent by describing in detail exemplary embodiments thereof with reference to the attached figures, wherein like reference numerals refer to like parts throughout the various figures unless otherwise specified. In the figures.

DETAILED DESCRIPTION OF EXEMPLARY EMBODIMENTS

Hereinafter, exemplary embodiments of the invention will be described in detail with reference to the accompanying drawings.

Figure 1:
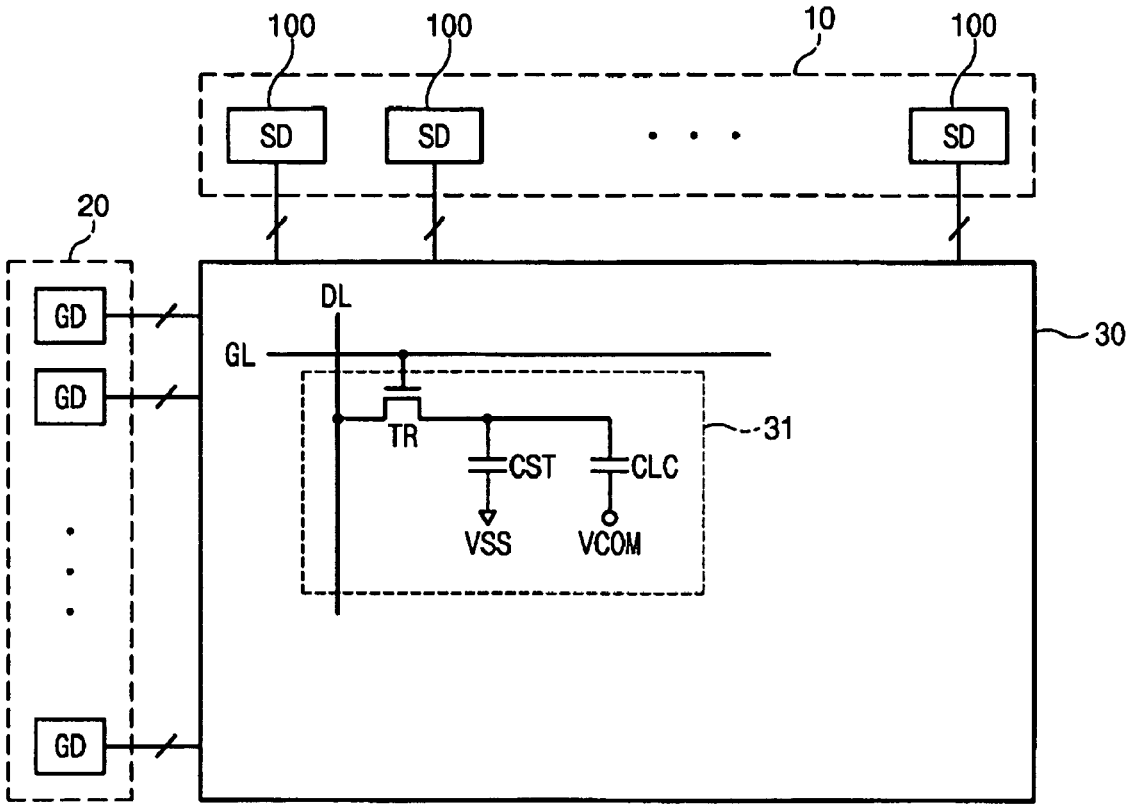
FIG. 1 is a block diagram illustrating a structural configuration of an LCD device according to an exemplary embodiment of the invention.

FIG. 1 is a block diagram illustrating a structural configuration of an LCD device according to an exemplary embodiment of the invention. Referring to FIG. 1, the LCD device is comprised of an LCD panel 30, a source driver (SD) block 10, and a gate driver (GD) block 20.

The source driver block 10 is composed of a plurality of source drivers (SD) 100, and the gate driver block 20 is composed of a plurality of gate drivers GD. The source drivers SD of the block 10 drive data lines DL arranged on the LCD panel 30. The gate drivers GD of the block 20 drive gate lines GL arranged on the LCD panel 30. Here, the data lines are also called source lines or channels.

The LCD panel 30 includes a plurality of pixels 31. Each pixel includes a switching transistor TR, a storage capacitor CST for reducing leakage currents from liquid crystals, and a liquid crystal capacitor CLC. The switching transistor TR is enabled or disabled in response to a signal driving the gate line GL. One terminal of the switching transistor TR is connected to the data line DL. The storage capacitor CST is coupled between the other terminal of the switching transistor TR and a ground voltage terminal VSS. The liquid crystal capacitor CLC is coupled between the other terminal of the switching transistor TR and a common voltage VCOM.

An exemplary embodiment of the source driver 100 is composed of a shift register, a digital-to-analog converter (DAC), and source-driver output circuit. The shift register is for sequentially holding and shifting digital data supplied from a timing controller (not shown). The DAC is for transforming the digital data into analog voltage values. The source-driver output circuit is for driving data lines of the LCD panel in response to the analog voltage values. When a clock signal is applied to provide the analog voltage values for the LCD panel 30, the source-driver output circuit drives the data line DL to apply an image signal into the liquid crystal capacitor CLC through the switching transistor TR. In addition, the source driver 100 operates to generate offset values that oscillate up and down for two frames to visually remove random offset values from a target voltage.

Figure 2:
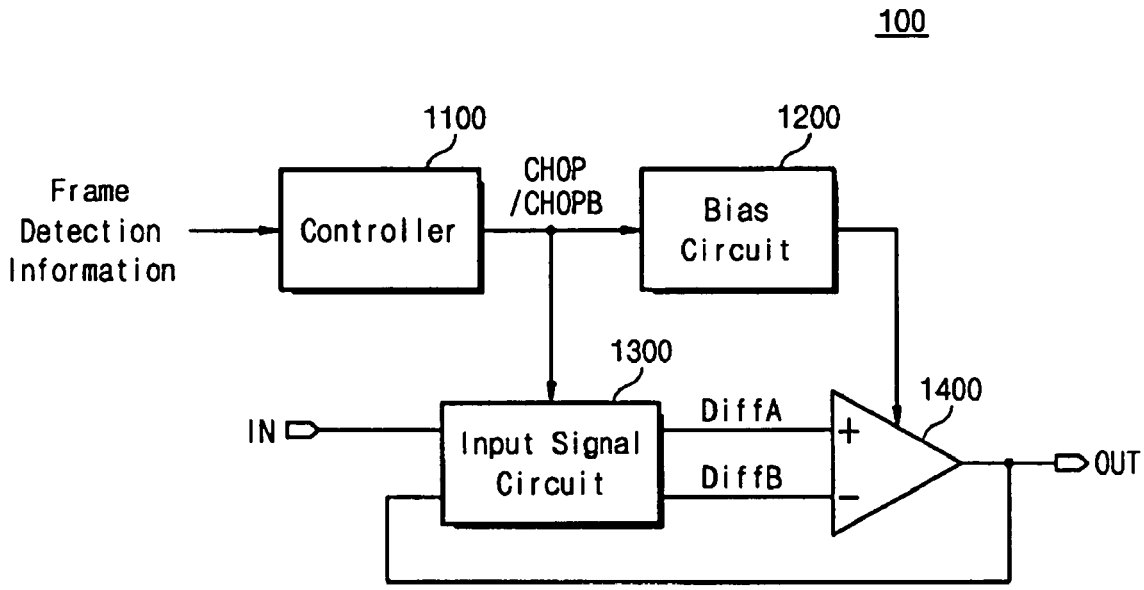
FIG. 2 is a circuit diagram illustrating a source driver according to an exemplary embodiment of the invention.

FIG. 2 is a circuit diagram illustrating the source driver 100 according to an exemplary embodiment of the invention. FIG. 2 illustrates a controller 1100, a bias circuit 1200, an input signal circuit 1300, and an output buffer 1400.

The controller 1100 generates signals CHOP and CHOPB that are complimentary to one another. The signals toggle at a predetermined frame period which is provided externally.

The bias circuit 1200 applies bias voltages V1~V8 to the output buffer 1400 in response to the signals CHOP and CHOPB input from the controller 1100.

The input signal circuit 1300 receives an input signal IN and an output signal OUT and then applies differential input signals DiffA and DiffB that are complimentary to one another to the output buffer 1400 in accordance with the signals CHOP and CHOPB. The following Table 1 lists values of the differential input signals DiffA and DiffB in accordance with the signals CHOP and CHOPB.

TABLE 1

| | | |
|---|---|---|
| CHOP High | DiffA | IN |
| | DiffB | OUT |
| CHOP Low | DiffA | OUT |
| | DiffB | IN |

Referring to Table 1, when the signal CHOP is set to a high level (High), the first differential input signal DiffA corresponds to the input signal IN while the second differential input signal DiffB corresponds to the output signal OUT. When the signal CHOP is set to a low level (Low), the first differential input signal DiffA corresponds to the output signal OUT while the second differential input signal DiffB corresponds to the input signal IN. The differential input signals DiffA and DiffB are dependent on the signals CHOP and CHOPB.

The output buffer 1400 generates the output signal OUT in response to the differential input signals DiffA and DiffB supplied by the input signal circuit 1300. The output buffer 1400 alternates random offset sources up and down for two frames, thereby visually removing random offset values from a target voltage. The random offset values have positive and negative values. Without an offset value, the target voltage is visually identified as the output signal OUT.

Figure 3:
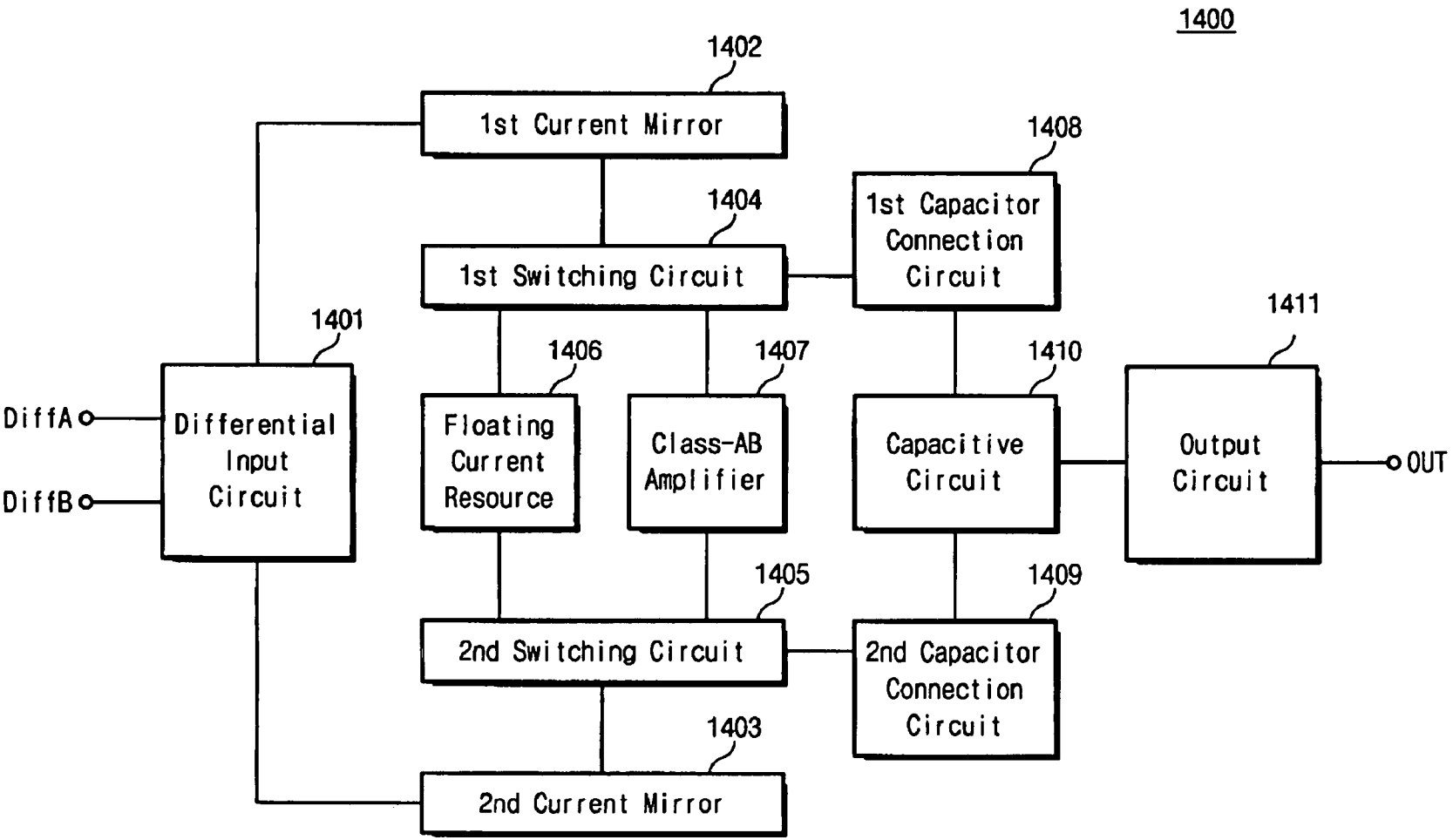
FIG. 3 is a block diagram illustrating the output buffer shown in FIG. 2 according to an exemplary embodiment of the invention.

FIG. 3 is a block diagram illustrating the output buffer 1400 shown in FIG. 2, according to an exemplary embodiment of the invention. Referring to FIG. 3, the output buffer 1400 is composed of a differential input circuit 1401, first and second current mirrors 1402 and 1403, first and second switching circuits 1404 and 1405, a floating current source 1406, a class-AB amplifier 1407, first and second capacitor connection circuits 1408 and 1409, a capacitive circuit 1410, and an output circuit 1411.

It is well known in the art that random offset is caused by mismatching among transistors of the differential input circuit 1401 and the first and second current mirrors 1402 and 1403. In an exemplary embodiment of the present invention, the transistors of the differential input circuit 1401 and the first and second current mirrors 1402 and 1403 are controlled to be conductive alternately for two frames, thereby visually removing random offsets from the output buffer 1400.

The differential input circuit 1401 outputs differential currents in response to the differential input signals DiffA and DiffB alternately oscillating in accordance with the signals CHOP and CHOPB.

The first and second current mirrors 1402 and 1403 generate addition currents from the differential currents, which are output from the differential input circuit 1401. The conduction of transistors of the first and second current mirrors 1402 and 1403 vary in accordance with the oscillation of the differential input signals DiffA and DiffB.

The first and second switching circuits 1404 and 1405 enable current paths to be properly conductive in the output buffer 1400 in accordance with the alternate operations of the transistors that constitute the differential input circuit 1401 and the first and second current mirrors 1402 and 1403.

The floating current source 1406 is connected to the first and second switching circuits 1404 and 1405 for controlling and maintaining constant bias currents.

The class-AB amplifier 1407 is responsible for improving a gain of the output buffer 1400.

The first and second capacitor connection circuits 1408 and 1409 operate to connect the capacitive circuit 1410 with the class-AB amplifier 1407 regardless of the alternate operations of the transistors belonging to the differential input circuit 1401 and the first and second current mirrors 1402 and 1403.

The output circuit 1411 generates the output signal OUT in response to a voltage supplied by the capacitive circuit 1410.

Figure 4:
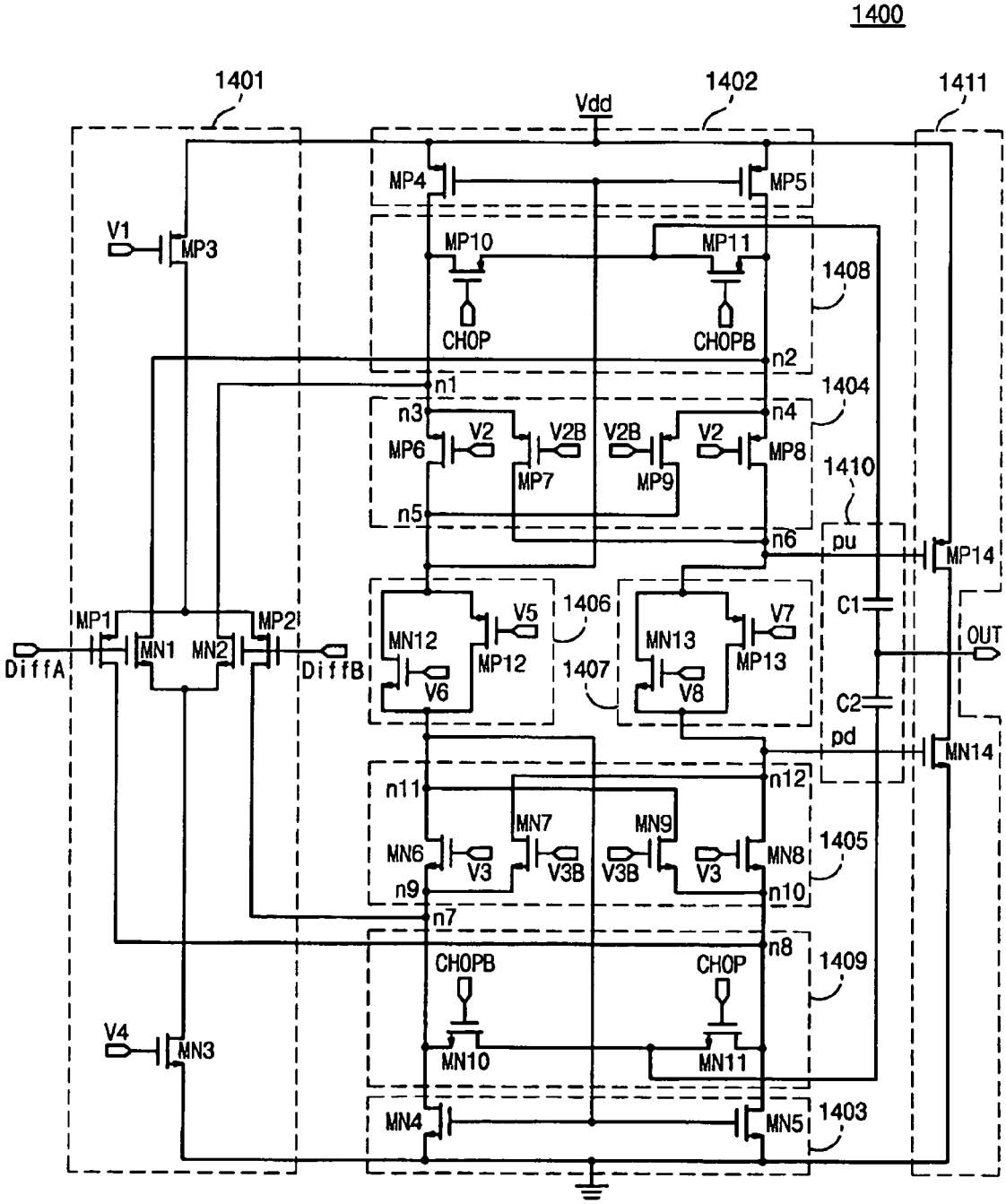
FIG. 4 is a circuit diagram illustrating the output buffer shown in FIG. 3 according to an exemplary embodiment of the invention.

FIG. 4 is a circuit diagram illustrating the output buffer 1400 shown in FIG. 3, according to an exemplary embodiment of the invention.

Referring to FIG. 4, the differential input circuit 1401 includes PMOS transistors, MP1, MP2, and MP3, and NMOS transistors MN1, MN2, and MN3, generating differential currents in response to the differential input signals DiffA and DiffB generated from the complementary signals CHOP and CHOPB. The differential input circuit 1401 includes a first differential input pair composed of the first and second PMOS transistors MP1 and MP2, and a second differential input pair composed of the first and second NMOS transistors MN1 and MN2. The third PMOS and NMOS transistors MP3 and MN3 supply bias currents to the first and second differential input pairs. The third PMOS transistor MP3 applies a constant bias current to the first differential input pair by the first bias voltage V1, and the third NMOS transistor MN3 applies a constant bias current to the second differential input pair by the fourth bias voltage V4. The first and second differential input pairs each divide the bias currents input thereto and then output differential currents toward the first and second current mirrors 1402 and 1403. The differential input signals DiffA and DiffB input to the differential input circuit 1401 vary according to the signals CHOP and CHOPB, as shown in Table 1.

The first current mirror 1402 is composed of PMOS transistors MP4 and MP5. The source of the fourth PMOS transistor MP4 is connected to a power source voltage Vdd. The gate of the fourth PMOS transistor MP4 is coupled to the gate of the fifth PMOS transistor MP5. The drain of the fourth PMOS transistor MP4 is connected to the drain of the second NMOS transistor MN2 at a first node n1. The source of the fifth PMOS transistor MP5 is connected to the power source voltage Vdd. The gate of the fifth PMOS transistor MP5 is coupled to the gate of the fourth PMOS transistor MP4. The drain of the fifth PMOS transistor MP5 is connected to the drain of the first NMOS transistor MN1 at a second node n2. When the signal CHOP is set to a high level (High), and the input and output signals IN and OUT are applied respectively as the first and second differential input signals DiffA and DiffB, a current from the output signal OUT flows through the first node n1 connected to the drain of the fourth PMOS transistor MP4, while a current from the input signal IN flows through the second node n2 connected to the drain of the fifth PMOS transistor MP5. When the signal CHOP is set to a low level (Low), and the input and output signals IN and OUT are applied respectively as the second and first differential input signals DiffB and DiffA, a current from the input signal IN flows through the first node n1 connected to the drain of the fourth PMOS transistor MP4, while a current from the output signal OUT flows through the second node n2 connected to the drain of the fifth PMOS transistor MP5.

The second current mirror 1403 is composed of NMOS transistors MN4 and MN5. The source of the fourth NMOS transistor MN4 is connected to the ground voltage Vss. The gate of the fourth NMOS transistor MN4 is coupled to the gate of the fifth NMOS transistor MN5. The drain of the fourth NMOS transistor MN4 is connected to the drain of the second PMOS transistor MP2 at a seventh node n7. The source of the fifth NMOS transistor MN5 is connected to the ground voltage Vss. The gate of the fifth NMOS transistor MN5 is coupled to the gate of the fourth NMOS transistor MN4. The drain of the fifth NMOS transistor MN5 is connected to the drain of the first PMOS transistor MP1 at an eighth node n8. When the signal CHOP is set to a high level (High), and the input and output signals IN and OUT are applied respectively as the first and second differential input signals DiffA and DiffB, a current from the output signal OUT flows through the seventh node n7 connected to the drain of the fourth NMOS transistor MN4, while a current from the input signal IN flows through the eighth node n8 connected to the drain of the fifth NMOS transistor MN5. When the signal CHOP is set to a low level (Low), and the input and output signals IN and OUT are applied respectively as the second and first differential input signals DiffB and DiffA, a current from the input signal IN flows through the seventh node n7 connected to the drain of the fourth NMOS transistor MN4, while a current from the output signal OUT flows through the eighth node n8 connected to the drain of the fifth NMOS transistor MN5.

The first switching circuit 1404 is composed of PMOS transistors MP6, MP7, MP8, and MP9. The sixth PMOS transistor MP6 is connected between third and fifth nodes n3 and n5, the gate of which is coupled to the second bias to voltage V2. The seventh PMOS transistor MP7 is connected between the third and sixth nodes n3 and n6, the gate of which is supplied with a logically inverse level V2B of the second bias voltage V2. The eighth PMOS transistor MP8 is connected between the fourth and sixth nodes n4 and n6, the gate of which is coupled to the second bias voltage V2. The ninth PMOS transistor MP9 is connected between the fourth and fifth nodes n4 and n5, the gate of which is supplied with the inverse level V2B of the second bias voltage V2. If the second bias voltage V2 is set to a low level (Low), the sixth and eighth PMOS transistors MP6 and MP8 are enabled while the seventh and ninth PMOS transistors MP7 and MP9 are disabled. As a result, current paths are generated between the third and fifth nodes n3 and n5, and between the fourth and sixth nodes n4 and n6. However, if the second bias voltage V2 is set to a high level (High), the sixth and eighth PMOS transistors MP6 and MP8 are disabled, while the seventh and ninth PMOS transistors MP7 and MP9 are enabled. As a result, current paths are generated between the third and sixth nodes n3 and n6, and between the fourth and fifth nodes n4 and n5. The second bias voltage V2 is generated by the bias circuit 1200 in response to the signals CHOP and CHOPB.

The second switching circuit 1405 is composed of NMOS transistors MN6, MN7, MN8, and MN9. The sixth NMOS transistor MN6 is connected between the eleventh and ninth nodes n11 and n9, the gate of which is coupled to the third bias voltage V3. The seventh NMOS transistor MN7 is connected between the twelfth and ninth nodes n12 and n9, the gate of which is supplied with a logically inverse level V3B of the third bias voltage V3. The eighth NMOS transistor MN8 is connected between the twelfth and tenth nodes n12 and n10, the gate of which is coupled to the third bias voltage V3. The ninth NMOS transistor MN9 is connected between the eleventh and tenth nodes n1 and n10, the gate of which is supplied with the inverse level V3B of the third bias voltage V3. If the third bias voltage V3 is set to a high level (High), the sixth and eighth NMOS transistors MN6 and MN8 are enabled while the seventh and ninth NMOS transistors MN7 and MN9 are disabled. As a result, current paths are generated between the eleventh and ninth nodes n11 and n9, and between the twelfth and tens nodes n12 and n10. However, if the third bias voltage V3 is set to a low level (Low), the sixth and eighth NMOS transistors MN6 and MN8 are disabled, while the seventh and ninth NMOS transistors MN7 and MN9 are enabled. As a result, current paths are generated between the eleventh and tenth nodes n11 and n10, and between the twelfth and ninth nodes n12 and n9. The third bias voltage V3 is generated by the bias circuit 1200 in response to the signals CHOP and CHOPB.

The floating current source 1406 includes twelfth PMOS and NMOS transistors MP12 and MN12 connected in parallel. The twelfth PMOS and NMOS transistors MP12 and MN12 control and retain constant bias currents in response to the fifth and sixth bias voltages V5 and V6. The floating current source 1406 may be made up of a single current source (not shown) without using the transistors MP12 and MN12.

The class-AB amplifier 1407 includes thirteenth PMOS and NMOS transistors MP13 and MN13 connected in parallel. The thirteenth PMOS and NMOS transistors MP13 and MN13 amplify an output gain therein, in response to the seventh and eighth bias voltages V7 and V8.

The first capacitor connection circuit 1408 includes tenth and eleventh PMOS transistors MP10 and MP11, while the second capacitor connection circuit 1409 includes tenth and eleventh NMOS transistors MN10 and MN11. The transistors, MP10, MP11, MN10, and MN11 are enabled or disabled in response to the signals CHOP and CHOPB, controlling the connection of the capacitive circuit 1410 to the class-AB amplifier 1407.

The capacitive circuit 1410 includes capacitors C1 and C2 to stabilize a frequency characteristic of an output voltage generated from the class-AB amplifier 1407.

The output circuit 1411 includes fourteenth PMOS and NMOS transistors MP14 and MN14. The output circuit 1411 receives the voltages from class-AB amplifier 1407 and then generates the output signal OUT.

The random offset value generated by the output buffer 1400 is given by Equation 1 as follows:

$$V_{os1} = \Delta V_{th,MP1,MP2} - \sqrt{\frac{2\beta_{MP4,MP5}}{\beta_{MP1,MP2}}}\,\Delta V_{th,MP4,MP5} - \sqrt{\frac{2\beta_{MN4,MN5}}{\beta_{MP1,MP2}}}\,\Delta V_{th,MN4,MN5} + \frac{V_{sg,eff,MP1,MP2}}{2}\left(-\frac{\Delta\beta_{MP1,MP2}}{\beta_{MP1,MP2}} + 2\frac{\Delta\beta_{MP4,MP5}}{\beta_{MP4,MP5}} + 2\frac{2\beta_{MN4,MN5}}{\beta_{MN4,MN5}}\right) \quad \text{[Equation 1]}$$

In Equation 1, $V_{th}$ is a threshold voltage of the MOS transistor and the transconductance β is defined by $$\frac{1}{2}\mu_n C_{ox}\frac{W}{L}.$$

If Equation 1 represents a random offset value appearing when the signal CHOP is set to a high level (High), the random offset value corresponding to when the signal CHOP is set to a low level (Low) can be defined as follows.

$$V_{os2} = -\Delta V_{th,MP1,MP2} + \sqrt{\frac{2\beta_{MP4,MP5}}{\beta_{MP1,MP2}}}\,\Delta V_{th,MP4,MP5} + \sqrt{\frac{2\beta_{MN4,MN5}}{\beta_{MP1,MP2}}}\,\Delta V_{th,MN4,MN5} + \frac{V_{sg,eff,MP1,MP2}}{2}\left(+\frac{\Delta\beta_{MP1,MP2}}{\beta_{MP1,MP2}} - 2\frac{\Delta\beta_{MP4,MP5}}{\beta_{MP4,MP5}} - 2\frac{\Delta\beta_{MN4,MN5}}{\beta_{MN4,MN5}}\right) \quad \text{[Equation 2]}$$

Thus, according to Equations 1 and 2, the offset value appearing from the output buffer 1400 are set to be a positive ($V_{os1}$) or negative ($V_{os2}$) value in accordance with the states of the signals CHOP and CHOPB, so that a target voltage without the offset value is visually identified as the output signal OUT on the LCD panel.

Figure 5:
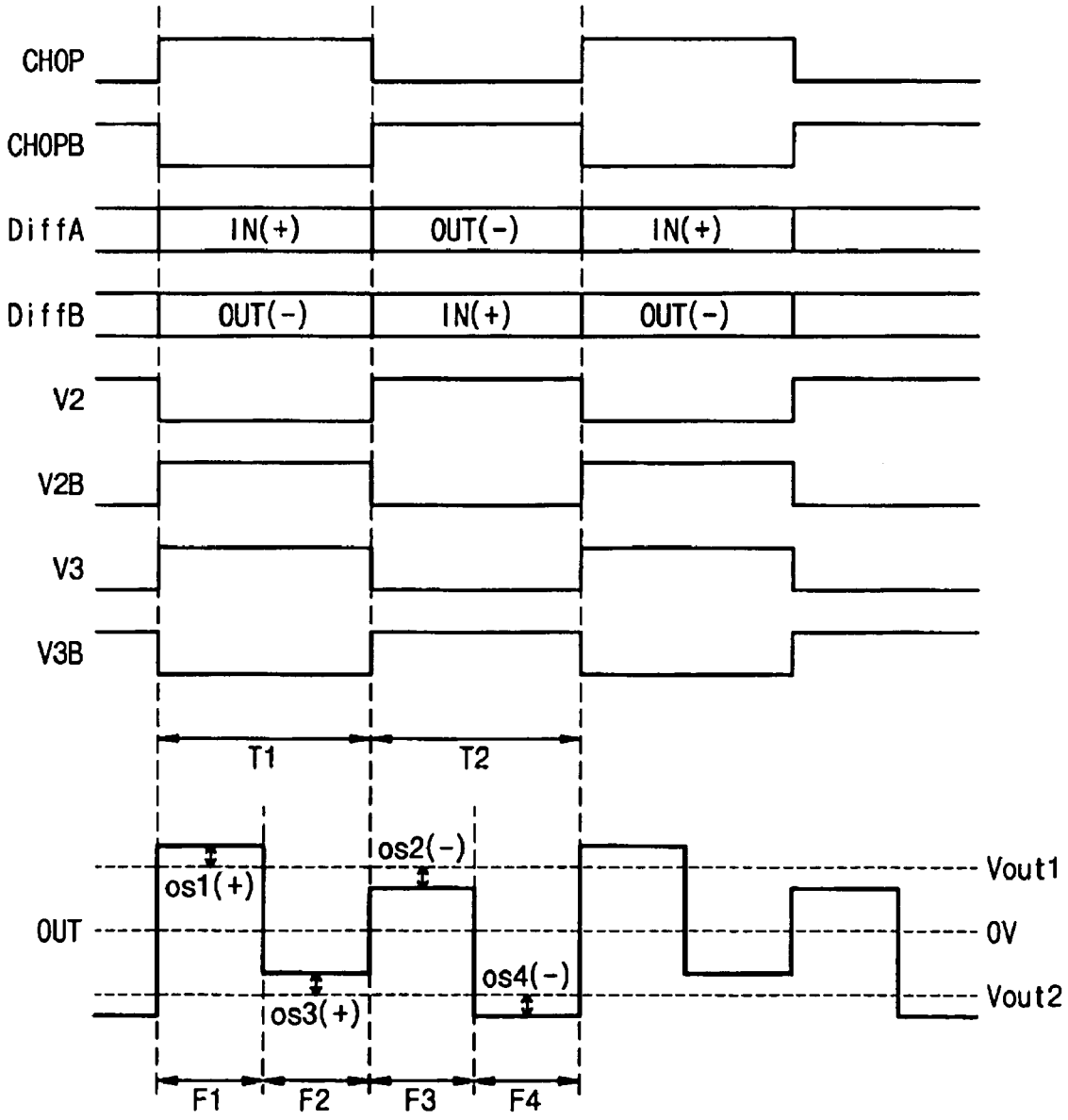
FIG. 5 is a timing diagram illustrating an operation of the output buffer shown in FIG. 4.

FIG. 5 is a timing diagram illustrating an operation of the output buffer 1400 shown in FIG. 4. The signals CHOP and CHOPB are periodically toggled every two frames. The states of signals CHOP and CHOPB determine the values of the differential input signals DiffA and DiffB and the second and third bias voltages V2 and V3. When the output signal OUT is generated, a first frame F1 is set with a positive offset value os1 by the signal CHOP of a high level, while a third frame F3 is set with a negative offset value os2 by the signal CHOP of a low level. The output signal OUT is visually identified as a positive target voltage Vout1 when the positive and negative offset values os1 and os2 cancel each other out. The output signal OUT is visually identified as a negative target voltage Vout2 when the positive and negative offset values os3 and os4 from the second and fourth frames F2 and F4 cancel each other out.

By alternately operating the differential input circuit 1401 and the first and second current mirrors 1402 and 1403, which are the sources of the random offsets from the output buffer 1400, along the signals CHOP and CHOPB, the random offset effects are visually removed from the output buffer 1400.

The above described features may be adaptable to other flat panel display apparatus, such as electrochromic display (ECD) device, digital mirror device (DMD), actuated mirror device (AMD), grating light value (GLV) device, plasma display panel (PDP) device, or vacuum fluorescent display (VFD) device. Further, the LCD device disclosed by the invention may be applicable to large-picture televisions, high-definition televisions, portable computers, camcorders, vehicle-specific displays, or multimedia for communication of information.

Although the exemplary embodiments of the present invention have been described in detail with reference to the accompanying drawings for the purpose of illustration, it is to be understood that the that the inventive processes and systems are not to be construed as limited thereby. It will be readily apparent to those of ordinary skill in the art that various modifications to the foregoing exemplary embodiments can be made therein without departing from the scope of the invention as defined by the appended claims, with equivalents of the claims to be included therein.

What is claimed is:

1. A source driver comprising:

an input signal circuit receiving a first toggling signal CHOP and a second toggling signal CHOPB that are complimentary to one another, and an input signal distinct from the toggling signals, the input signal circuit alternately toggling a first differential input signal DiffA and a second differential input signal DiffB in accordance with the first toggling signal CHOP and the second toggling signal CHOPB and outputting the first and second toggled differential input signals;

an output buffer inputting the alternately toggled first and second differential input signals, generating a data-line driver signal in response to the alternately toggled first and second differential input signals, and feeding the data-line driver signal as input to the input signal circuit; and a controller generating the toggling signals CHOP and CHOPB that toggle at a predetermined frame period, wherein the period of each of the toggling signals CHOP and CHOPB corresponds to four frames of the data-line driver signal, wherein the input signal circuit is configured to output one of:

the first differential input signal DiffA to correspond to the input signal and the second differential input signal DiffB to correspond to the feedback data-line driver signal, or the first differential input signal DiffA to correspond to the feedback data-line driver signal and the second differential input signal DiffB to correspond to the input signal, based on the toggling signals CHOP and CHOPB.

2. The source driver as set forth in claim 1, wherein the predetermined frame period is equal to two frames.

3. The source driver as set forth in claim 1, wherein the output buffer comprises:

a differential input circuit generating differential currents from differential input voltages;

current mirrors generating addition currents from the differential currents; a floating current source supplying constant bias currents to the current mirrors;

a class-AB amplifier configured to amplify a voltage corresponding to the addition currents; and an output circuit configured to generate an output signal along the amplified voltage.

4. The source driver as set forth in claim 3, wherein the differential input voltages are toggled with an input signal and the output signal of the output buffer in response to the pair of signals.

5. The source driver as set forth in claim 4, wherein each of the current mirrors include transistors, the transistors being alternately conductive in response to the pair of signals.

6. The source driver as set forth in claim 5, wherein the output buffer maintains a current path through the current mirrors regardless of the state of the differential input voltages.

7. The source driver as set forth in claim 3, wherein the output buffer further comprises a capacitive circuit for stabilizing frequency characteristics of the amplified voltage.

8. The source driver as set forth in claim 7, wherein the capacitive circuit is electrically connected to the class-AB amplifier regardless of the state of the pair of signals.

9. A method of driving a source driver having an output buffer, the method comprising:

generating a pair of signals (CHOP and CHOPB) complimentary to each other, each of the signals toggling at a predetermined frame period;

generating a data-line drive signal with a positive offset value from the output buffer in response to the pair of signals; and generating a data-line drive signal with a negative offset value, subsequent to the data-line drive signal having the positive offset value, from the output buffer in response to the pair of signals, wherein the output buffer responds to a first differential input signal DiffA and a second differential input signal DiffB that are toggled alternately by an input signal circuit of the source driver in accordance with the pair of signals (CHOP and CHOPB), wherein the period of the pair of signals CHOP and CHOPB corresponds to four frames of the data-line driver signal, wherein the data-line driver signal is fed from an output of the output buffer to an input of the input signal circuit, wherein the input signal circuit receives an input signal distinct from the toggling signals CHOP and CHOPB, wherein the input signal circuit is configured to output one of:

the first differential input signal DiffA to correspond to the input signal and the second differential input signal DiffB to correspond to the data-line driver signal, or the first differential input signal DiffA to correspond to the data-line driver signal and the second differential input signal DiffB to correspond to the input signal, based on the toggling signals CHOP and CHOPB.

10. The method as set forth in claim 9, wherein the predetermined frame period is equal to two frames.

11. The method as set forth in claim 9, wherein the output buffer responds to differential input voltages toggling with the pair of signals.

12. The method as set forth in claim 9, wherein the positive and negative offset values are generated from mismatching and processing conditions of transistors of the output buffer.

13. The source driver of claim 1, wherein the first and second differential input signals DiffA and DiffB are complimentary to one another.

14. The method of claim 9, wherein the first and second differential input signals DiffA and DiffB are complimentary to one another.

15. A source driver comprising:

an input signal circuit receiving an input signal and a first toggling signal CHOP and a second toggling signal CHOPB that are complimentary to one another, and generating a first differential input signal DiffA and a second differential input signal DiffB;

an output buffer inputting the first and second differential input signals DiffA and DiffB, generating the data-line driver signal in response to the input first and second differential input signals, and feeding the data-line driver signal as input to the input signal circuit; and a controller generating the first toggling signal CHOP and the second toggling signal CHOPB that toggle at a predetermined frame period, wherein the period of each of the first toggling signal CHOP and the second toggling signal CHOPB correspond to four frames of the data-line driver signal, wherein the input signal circuit is configured to output one of:

the first differential input signal DiffA to correspond to the input signal and the second differential input signal DiffB to correspond to the data-line driver signal, or the first differential input signal DiffA to correspond to the data-line driver signal and the second differential input signal DiffB to correspond to the input signal, based on the toggling signals CHOP and CHOPB.

16. The source driver of claim 15, wherein the first differential input signal DiffA corresponds to the data-line driver signal and the second differential input signal DiffB corresponds to the input signal when the first toggling signal CHOP is set to a first value and the first differential input signal DiffA corresponds to the input signal and the second differential input signal DiffB corresponds to the data-line driver signal when the first toggling signal CHOP is set to second value different from the first.

17. The source driver of claim 15, further comprising a bias circuit outputting bias voltages to the output buffer in response to the first toggling signal CHOP and the second toggling signal CHOPB received from controller.

18. The source driver of claim 15, wherein the controller receives frame detection information that indicates the predetermined frame period.

19. The source driver of claim 18, wherein the predetermined frame period is two frames.

20. The source driver of claim 15, wherein the output buffer comprises:

a differential input circuit generating differential currents from differential input voltages;

current mirrors generating addition currents from the differential currents; a floating current source supplying constant bias currents to the current mirrors;

a class-AB amplifier configured to amplify a voltage corresponding to the addition currents; and an output circuit configured to generate an output signal along the amplified voltage.

* * * * *